US012279739B2

(12) United States Patent
Park et al.

(10) Patent No.: US 12,279,739 B2
(45) Date of Patent: Apr. 22, 2025

(54) MOTOR ASSEMBLY AND A CLEANER COMPRISING THE SAME

(71) Applicant: Samsung Electronics Co., Ltd., Suwon-si (KR)

(72) Inventors: Taesang Park, Suwon-si (KR); Minsuk Kang, Suwon-si (KR); Dongsuk Ko, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 38 days.

(21) Appl. No.: 17/241,229

(22) Filed: Apr. 27, 2021

(65) Prior Publication Data

US 2021/0330146 A1 Oct. 28, 2021

(30) Foreign Application Priority Data

Apr. 27, 2020 (KR) ..... 10-2020-0050987

(51) Int. Cl.

| | |
|---|---|
| ***F04D 29/16*** | (2006.01) |
| ***A47L 5/22*** | (2006.01) |
| ***A47L 9/22*** | (2006.01) |
| ***F04D 29/30*** | (2006.01) |
| ***F04D 29/62*** | (2006.01) |
| *F04D 29/28* | (2006.01) |
| *F04D 29/52* | (2006.01) |

(52) U.S. Cl.

CPC ..... *A47L 5/22* (2013.01); *A47L 9/22* (2013.01); *F04D 29/30* (2013.01); *F04D 29/622* (2013.01); *F04D 29/162* (2013.01); *F04D 29/167* (2013.01); *F04D 29/281* (2013.01); *F04D 29/289* (2013.01); *F04D 29/526* (2013.01)

(58) Field of Classification Search

CPC .... F04D 29/162; F04D 29/167; F04D 29/526; F04D 29/281; F04D 29/289

See application file for complete search history.

(56) References Cited

U.S. PATENT DOCUMENTS

| | | | | |
|---|---|---|---|---|
| 9,163,640 | B2 * | 10/2015 | Chang | F04D 29/051 |
| 10,119,411 | B2 * | 11/2018 | Dimova | F04D 25/024 |
| 10,527,051 | B2 * | 1/2020 | Masutani | F04D 25/163 |
| 2009/0067991 | A1 * | 3/2009 | Hwang | F04D 25/0613 415/203 |
| 2012/0247739 | A1 * | 10/2012 | Fujiwara | F04D 29/424 415/220 |
| 2012/0301277 | A1 * | 11/2012 | Chang | F04D 29/30 415/119 |
| 2013/0156572 | A1 | 6/2013 | Murador et al. | |
| 2014/0131018 | A1 | 5/2014 | Lee et al. | |

(Continued)

FOREIGN PATENT DOCUMENTS

| | | | |
|---|---|---|---|
| EP | 3 618 240 A1 | 3/2020 | |
| JP | H05106598 A * | 10/1991 | F04D 29/162 |

(Continued)

OTHER PUBLICATIONS

JPH05106598—Translation from Espacenet (Year: 1991).*

(Continued)

*Primary Examiner* — Woody A Lee, Jr.
*Assistant Examiner* — Behnoush Haghighian
(74) *Attorney, Agent, or Firm* — STAAS & HALSEY LLP

(57) ABSTRACT

A motor assembly is disclosed. The motor assembly includes a motor having an axis, an impeller having a plurality of wings and configured to connect with the axis, and an impeller cover configured to cover a side surface of the impeller and disposed spaced apart from the impeller by a pre-set distance, and at least one from among the plurality of wings includes a protrusion disposed between the impeller cover and the wing.

6 Claims, 17 Drawing Sheets

(56) References Cited

U.S. PATENT DOCUMENTS

| | | | | |
|---|---|---|---|---|
| 2014/0356131 | A1 | 12/2014 | Park et al. | |
| 2016/0264028 | A1* | 9/2016 | Kawashima | F04D 29/281 |
| 2017/0184117 | A1* | 6/2017 | Lu | F04D 29/30 |
| 2018/0030992 | A1* | 2/2018 | Masutani | F04D 17/125 |
| 2018/0080456 | A1* | 3/2018 | Masutani | F04D 29/162 |
| 2018/0209442 | A1 | 7/2018 | Sawada et al. | |
| 2020/0163514 | A1* | 5/2020 | Lee | A47L 9/22 |
| 2020/0195081 | A1 | 6/2020 | Eason et al. | |
| 2020/0195091 | A1* | 6/2020 | Kim | F04D 29/043 |
| 2020/0200184 | A1* | 6/2020 | Iwasaki | F04D 29/284 |
| 2021/0235951 | A1 | 8/2021 | Hwang et al. | |

FOREIGN PATENT DOCUMENTS

| | | | |
|---|---|---|---|
| JP | 9-242692 | A | 9/1997 |
| JP | 2008-303740 | | 12/2008 |
| JP | 2010-249036 | | 11/2010 |
| JP | 2019-100242 | | 6/2019 |
| KR | 20-0323344 | | 8/2003 |
| KR | 10-1975337 | B1 | 5/2019 |
| KR | 10-2019-0127044 | | 11/2019 |
| KR | 10-2054681 | B1 | 12/2019 |
| WO | WO 2018/003051 | A1 | 1/2018 |

OTHER PUBLICATIONS

International Search Report dated Aug. 17, 2021 from International Application No. PCT/KR2021/005140.

Written Opinion of the International Searching Authority dated Aug. 17, 2021 from International Application No. PCT/KR2021/005140.

Extended European Search Report dated Jun. 7, 2023 in European Patent Application No. 21797829.5.

Korean Office Action issued on Jun. 25, 2024 for Korean Patent Application No. 10-2020-0050987.

* cited by examiner

MOTOR ASSEMBLY AND A CLEANER COMPRISING THE SAME

CROSS-REFERENCE TO RELATED APPLICATION

This application is based on and claims priority under 35 U.S.C. § 119 to Korean patent application number 10-2020-0050987, filed on Apr. 27, 2020, in the Korean Intellectual Property Office, the disclosure of which is incorporated by reference herein in its entirety.

BACKGROUND

1. Field

The disclosure relates to a motor assembly having an improved structure to enhance suctioning performance and a cleaner comprising the same. More particularly, the disclosure relates to a motor assembly having an improved structure to maintain a distance between an impeller and an impeller cover at a minimum and a cleaner comprising the same.

2. Description of Related Art

In general, a cleaner may be a device configured to suction air of a surface-to-be-cleaned, separate and collect dust or contaminants from the suctioned air, and discharge purified air to the outside of a body.

The cleaner as described above may be divided into a cleaner of a canister type, a cleaner of an upright type, a handy-type cleaner, a stick-type cleaner, or the like according to a shape thereof.

The cleaner may include a motor which is driven to generate suction force. The motor may be a machine which gains rotational force from electric energy, and may include a stator and a rotor, an impeller configured to generate suction force by rotating with the rotor, and an impeller cover configured to be disposed to surround the impeller.

Between the impeller and the impeller cover, a predetermined distance is provided, and the suctioning performance of the motor is at its maximum when this distance is at a minimum. However, when the distance between the impeller and the impeller cover becomes smaller, there has been the disadvantage of an excessive contact generating between the impeller and the impeller cover and thereby, a rotation of the impeller being hindered by frictional resistance.

SUMMARY

According to an embodiment, a motor assembly includes a motor having an axis, an impeller having a plurality of wings, and configured to connect with the axis, and an impeller cover configured to cover a side surface of the impeller, and disposed spaced apart from the impeller by a pre-set distance, and at least one from among the plurality of wings includes a protrusion disposed between the impeller cover and the wing.

The protrusion may be disposed to contact the impeller cover while the motor is in rotation.

The protrusion may be configured to have a height between 0.1 mm and 0.3 mm.

The protrusion may be configured to have any one material from among Teflon, a material comprised in part of Teflon, and a material coated with Teflon.

The protrusion may be comprised of a material having a lower hardness than the impeller cover.

The impeller cover may be configured to have any one material from among Teflon, a material comprised in part of Teflon, and a material coated with Teflon.

The impeller cover may be comprised of a material having a lower hardness than the protrusion.

The protrusion may be disposed on three different wings from among the plurality of wings.

According to another embodiment, a motor assembly includes a motor having an axis, an impeller having a plurality of wings, and configured to connect with the axis, and an impeller cover configured to cover a side surface of the impeller, and disposed spaced apart from the impeller by a pre-set distance, and the impeller cover comprises a protrusion formed along an inner circumferential surface of the impeller cover, and configured to protrude toward the plurality of wings.

The protrusion may be disposed to contact the plurality of wings while the motor is in rotation.

The protrusion may be configured to have a height between 0.1 mm and 0.3 mm.

The protrusion may be in a circular form configured to be formed continuously along an inner circumferential surface of the impeller cover.

The protrusion may be in a dotted-line form configured to be formed discontinuously along an inner circumferential surface of the impeller cover.

The protrusion may be comprised of a material having a lower hardness than the impeller.

According to an embodiment, a cleaner includes a cleaner body, a suction head configured to suction foreign material of a surface-to-be-cleaned to the cleaner body, and a motor assembly disposed inside the cleaner body, and the motor assembly includes a motor having an axis, an impeller having a plurality of wings, and configured to connect with the axis, and an impeller cover configured to cover a side surface of the impeller, and at least one from among the plurality of wings includes a protrusion configured to protrude toward the impeller cover on a surface facing the impeller cover.

The protrusion may be disposed to contact the impeller cover while the motor is in rotation.

The protrusion may be configured to have a height between 0.1 mm and 0.3 mm.

According to an embodiment, a manufacturing method of a motor assembly includes forming at least one protrusion on an impeller, manufacturing a sub assembly including a stator, a rotor, a motor housing accommodating the stator and the rotor, and the impeller configured to be fixed at one end of the rotor and disposed at an outside of the motor housing, disposing the sub assembly on an impeller cover so that at least one protrusion is configured to contact the impeller cover, and coupling the impeller cover to the motor housing.

The manufacturing method of the motor assembly may further include rotating the impeller for a pre-set time.

The rotating the impeller may include rotating the impeller at a speed higher than a regular rotation speed of the motor assembly.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
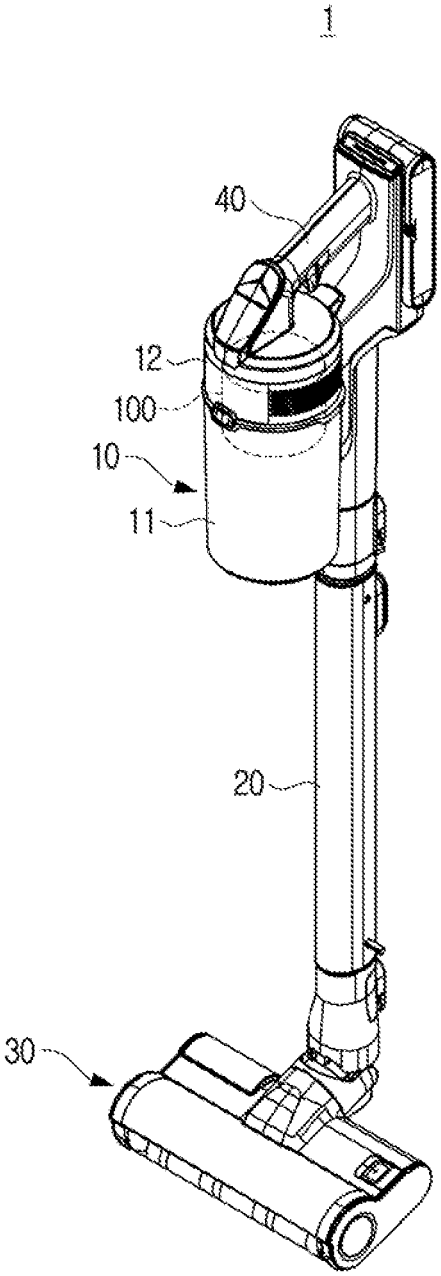
FIG. 1 is perspective view illustrating a stick-type cleaner including a motor assembly according to an embodiment.

One or more embodiments described below are example embodiments provided to assist in the understanding of the disclosure, and it is to be understood that the disclosure may be implemented to various forms and various modifications may be applied thereto different from the embodiments described herein. However, in case it is determined that in describing embodiments, detailed description of related known technologies or elements may unnecessarily confuse the gist of the disclosure, the detailed description and detailed illustration will be omitted. In addition, to assist in the understanding of the disclosure, the accompanied drawings are not illustrated to its actual scale and sizes of some elements may be exaggeratedly illustrated.

The terms used in describing the various example embodiments of the disclosure are general terms selected that are currently widely used considering their function herein. However, the terms may change depending on intention, legal or technical interpretation, emergence of new technologies, and the like of those skilled in the related art. Further, there may be terms arbitrarily selected. The meaning of these terms may be interpreted as defined in the disclosure, and unless specified otherwise, the terms may be interpreted based on the overall context of the disclosure and the technical common sense according to the related art.

In describing the disclosure, the order of each step is to be understood as non-limiting unless the order of each step needs to be performed such that a preceding step must be performed logically and temporally prior to a following step. That is, except for exceptional cases as described above, even if a process described as the following step is performed preceding a process described as the preceding step, it does not influence the nature of the disclosure and the scope of protection should also be defined regardless of the order of the step.

In the disclosure, expressions such as "comprise," "may comprise," "include," "may include," or the like are used to designate a presence of a corresponding characteristic (e.g., elements such as numerical value, function, operation, or component, etc.), and not to preclude a presence or a possibility of additional characteristics.

Terms such as "first," "second," and so on may be used to describe a variety of elements, but the elements should not be limited by these terms. The terms may be used only for the purpose of distinguishing one element from another. For example, a first element may be designated as a second element without departing from the scope and spirit of the present disclosure, and similarly, the second element may also be designated as the first element.

Terms such as 'front surface,' 'back surface,' 'top surface,' 'bottom surface,' 'side surface,' 'left side,' 'right side,' 'upper part,' 'lower part,' or the like used in herein have been defined based on the drawings, and it is to be understood that the form and location of each element is not limited by these terms.

Further, because elements necessary in describing each embodiment of the disclosure are described in the disclosure, the embodiments are not necessarily limited thereto. Accordingly, some elements may be modified or omitted, and other elements may be added. In addition, the elements may be distributed to devices independent from one another and arranged.

Aspects of the disclosure are to address at least the above-mentioned problems and/or disadvantages and to provide at least the advantages described below. Accordingly, an aspect of the disclosure is to provide a motor assembly having an improved structure to enhance suctioning force and a cleaner comprising the same.

Furthermore, although one or more embodiments of the disclosure have been described in detail below with reference to the accompanied drawings and the descriptions of the accompanied drawings, the disclosure is not limited to the embodiments.

The disclosure will be described in greater detail below with references to FIGS. 1 to 12 below.

FIG. 1 is perspective view illustrating a stick-type cleaner 1 including a motor assembly 100 according to an embodiment.

Referring to FIG. 1, a cleaner including the motor assembly 100 according to an embodiment may include the stick-type cleaner 1. However, the embodiment is not limited thereto, and the motor assembly 100 according to an embodiment may be applied to various devices. For example, the cleaner 1 according to an embodiment may be an upright-type cleaner.

In addition, the motor assembly 100 according to an embodiment may be applied to a variety of home appliances other than the cleaner. The stick-type cleaner 1 including the motor assembly 100 will be described as an example below.

The cleaner 1 may include a cleaner body 10 and a suction head 30. The cleaner 1 may include a stick 20 which connects the cleaner body 10 and the suction head 30 and a handling portion 40 which connects with the cleaner body 10.

The handling portion 40 may be a portion that couples to the cleaner body 10, and provided so that a user may grasp and operate the cleaner 1. The handling portion 40 may be provided with an operating portion (not shown) so that the user may control the cleaner 1.

The suction head 30 may be provided at a lower part of the cleaner body 10, and disposed so as to contact with a surface-to-be-cleaned. The suction head 30 may be provided so as to contact the surface-to-be-cleaned and introduce dust or contaminants of the surface-to-be-cleaned to the inside of the cleaner body with suction force generated from the motor assembly 100.

The cleaner body 10 may include a dust collecting device 11 and a driving device 12 which is disposed inside thereof. The dust collecting device 11 may be configured to separate foreign matter from the air suctioned from the suction head 30 and perform a dust collecting function.

The driving device 12 may include the motor assembly 100 provided so as to drive the cleaner 1. The motor assembly 100 may be configured to generate power so as to generate suction force inside of the cleaner body 10.

Figure 2:
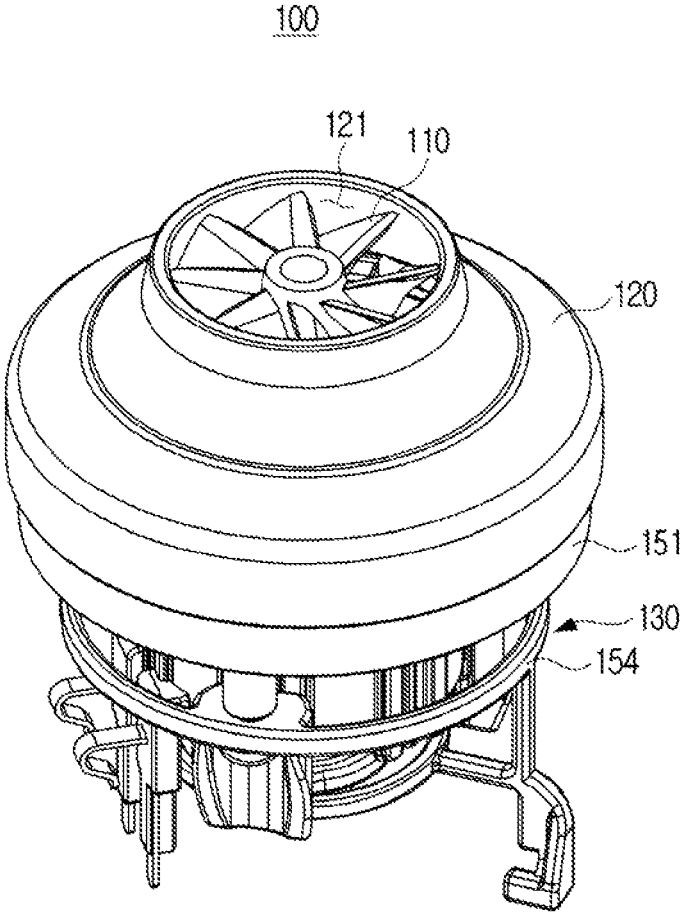
FIG. 2 is a perspective view illustrating a motor assembly according to an embodiment.
Figure 3:
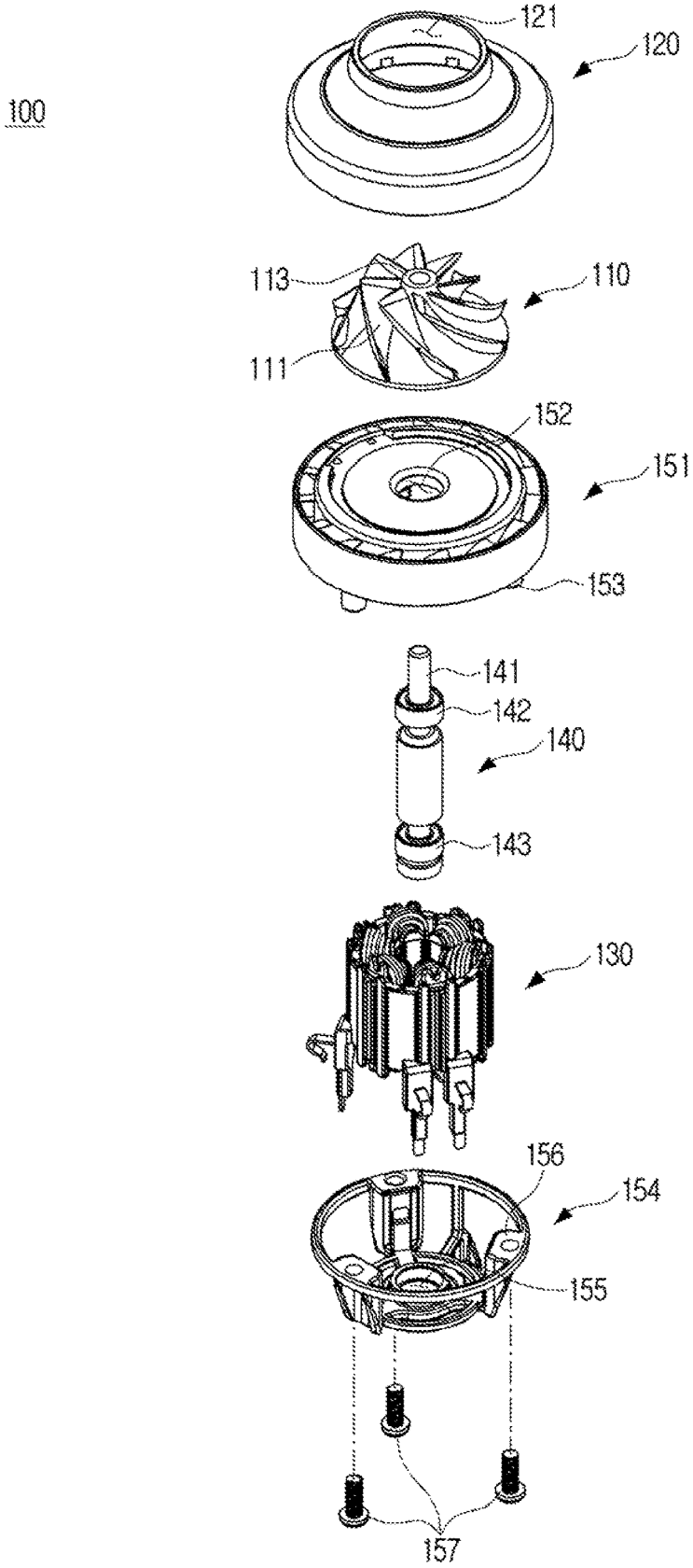
FIG. 3 is an exploded perspective view illustrating a motor assembly according to an embodiment.

FIG. 2 is a perspective view illustrating the motor assembly 100 according to an embodiment, and FIG. 3 is an exploded perspective view illustrating the motor assembly 100 according to an embodiment.

Referring to FIGS. 2 and 3, the motor assembly 100 may include a motor including a stator 130 (also element 230 of FIG. 11), a rotor 140 (also element 240 of FIG. 11), and motor housings 151 and 154, an impeller 110 configured to generate air flow by being coupled to a rotation shaft 141 (also element 241 of FIG. 11) of the rotor 140, and an impeller cover 120 configured to cover the impeller 110 and guide air suctioned by the impeller 110.

In addition, although not illustrated in FIGS. 2 and 3, the motor assembly 100 may include a substrate (not shown) configured to control the motor assembly 100.

The motor may include the stator 130, motor housings 151 and 154 which couple to the stator 130, and the rotor 140 which is disposed to be rotatable inside of the stator 130.

The stator 130 may be configured to generate magnetic flux based on current being applied to a coil wound to the stator 130.

In the center portion of the stator 130, a space for accommodating the rotor 140 may be formed. The rotor 140 may be configured to electromagnetically interact with the stator 130. The rotor 140 may include a rotation shaft 141 and bearings 142 and 143.

The rotation shaft 141 may be provided so as to rotate when the rotor 140 and the stator 130 electromagnetically interacts.

The bearings 142 and 143 may include a first bearing 142 which couples to a top side of the rotation shaft 141 and a second bearing 143 which couples to a bottom side of the rotation shaft 141.

The first bearing 142 may be disposed between the first housing 151 and the rotation shaft 141, and may support the rotation shaft 141 to rotate while an axis of the rotation shaft 141 is fixed.

The second bearing 143 may be disposed between the second housing 154 and the rotation shaft 141, and may support the rotation shaft 141 to rotate while the axis of the rotation shaft 141 is fixed.

The motor housings 151 and 154 may be provided so as to couple to an outside of the stator 130. The motor housings 151 and 154 may include a first housing 151 which couples to one side of the stator 130, and a second housing 154 which couples to other side of the stator 130.

The first housing 151 and the second housing 154 may be coupled with the rotor 140 and the stator 130 placed therebetween. Because of the first housing 151 and the second housing 154 coupling, the rotor 140 may be disposed inside of the stator 130.

The first housing 151 may include a first bearing seating portion 152 in which the first bearing 142 is seated and a first coupling portion 153 configured to be extended in an axial direction and couple with the second housing 154.

The first housing 151 may be roughly a cylindrical shape, and the first coupling portion 153 may be extendingly formed in the axial direction from the first housing 151. The first coupling portion 153 may be comprised in plurality which are disposed spaced apart along a circumferential direction of the first housing 151. For example, as illustrated in FIG. 3, three first coupling portions 153 may be provided, but the number of first coupling portions 153 is not limited thereto.

The second housing 154 may include a second bearing seating portion 155 in which the second bearing 143 is seated, and a second coupling portion 156 provided so as to couple with the first coupling portion 153 of the first housing 151.

The second coupling portion 156 may be provided to correspond to the number of the first coupling portions 153. The first coupling portion 153 and the second coupling portion 156 may be coupled by various known methods. For example, the first coupling portion 153 and the second coupling portion 156 may be coupled by screw coupling using a bolt 157.

The motor assembly 100 may include the impeller 110 and the impeller cover 120. The impeller 110 may be coupled to the rotation shaft 141 of the rotor 140 and generate air flow. The impeller cover 120 may be disposed to cover the impeller 110.

The impeller 110 may include a shaft coupling portion 113 to which the rotation shaft 141 is coupled. Based on the rotation shaft 141 being mounted to the shaft coupling portion 113, the impeller 110 may be configured to rotate with the rotation shaft 141.

The impeller 110 may include a plurality of wings 111 which form air flow.

At least one from among the plurality of wings 111 may include a protrusion 112 (referring to FIG. 4) configured to be disposed between the impeller cover 120 and the wing 111. The detailed description on the protrusion 112 of the impeller 110 will be described below in FIGS. 4 to 8.

The impeller covers 120 and 220 may be disposed spaced apart from the impellers 110 and 210 at a pre-set distance. The impeller covers 120 and 220 may be coupled with the first housing 151. For example, the impeller covers 120 and 220 may be bonding coupled with the first housing 151 in a manufacturing process of the motor assemblies 100 and 200.

The impeller cover 220 may be formed along an inner circumferential surface of the impeller cover 220, and may include a protrusion 222 (referring to FIG. 9) configured to protrude toward the plurality of wings 211 of the impeller 210. The detailed description on the protrusion 222 of the impeller cover 220 will be described below in FIGS. 9 to 12.

FIGS. 4 to 8 are views illustrating the motor assembly 100 according to an embodiment.

Figure 4:
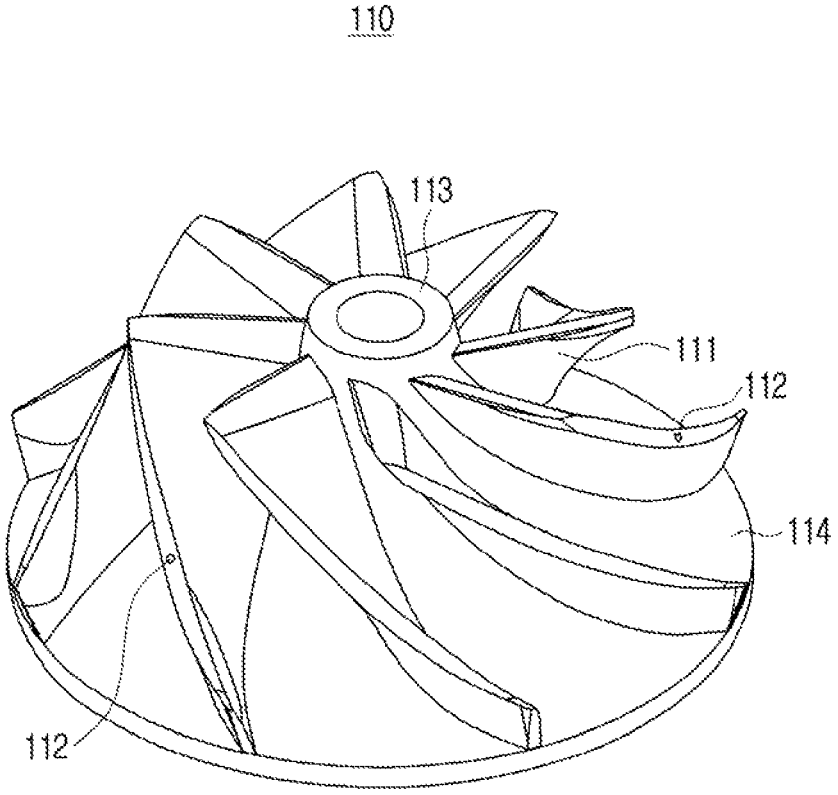
FIG. 4 is a perspective view illustrating an impeller according to an embodiment.
Figure 5:
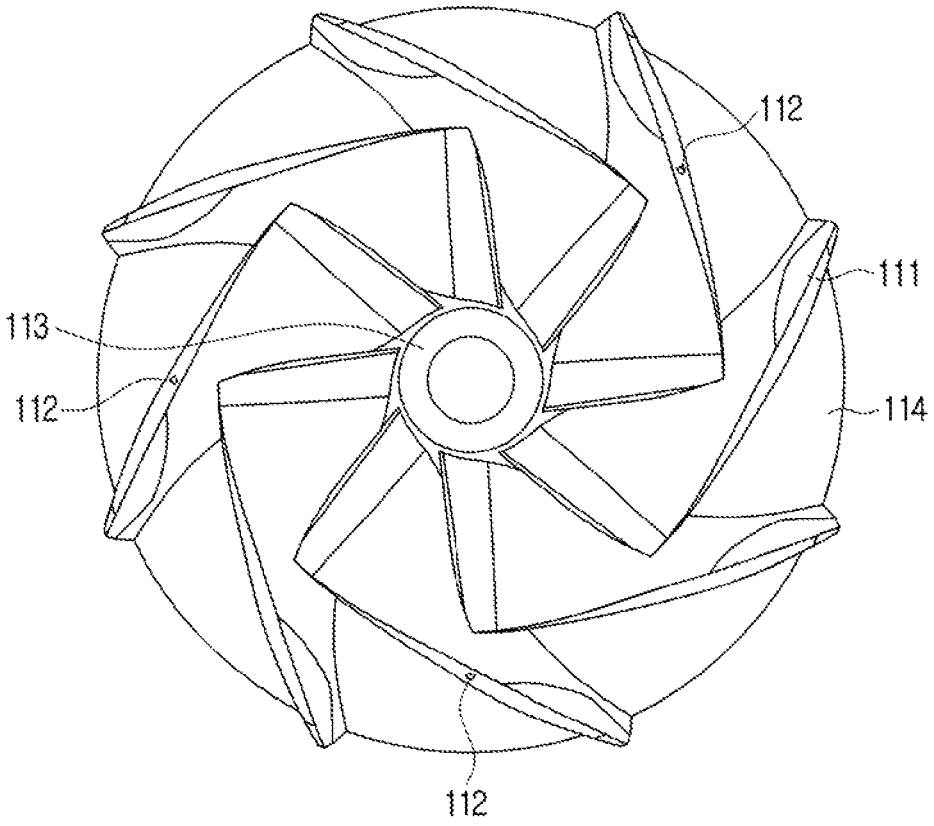
FIG. 5 is a plane view illustrating the impeller of FIG. 4.
Figure 6:
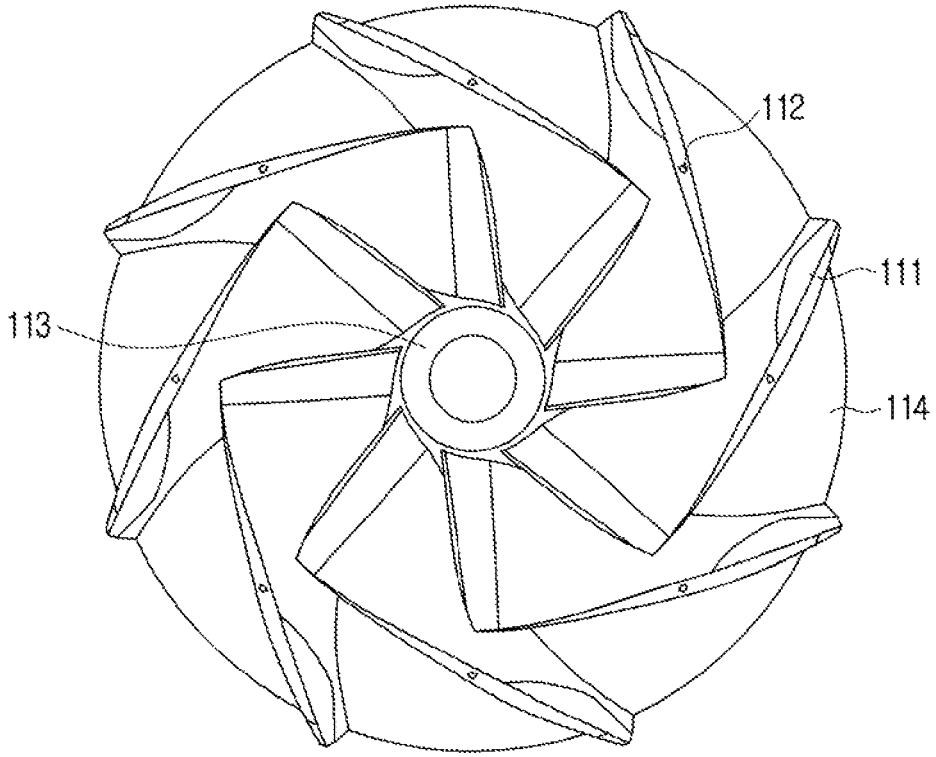
FIG. 6 is a plane view illustrating an impeller according to another embodiment.
Figure 7:
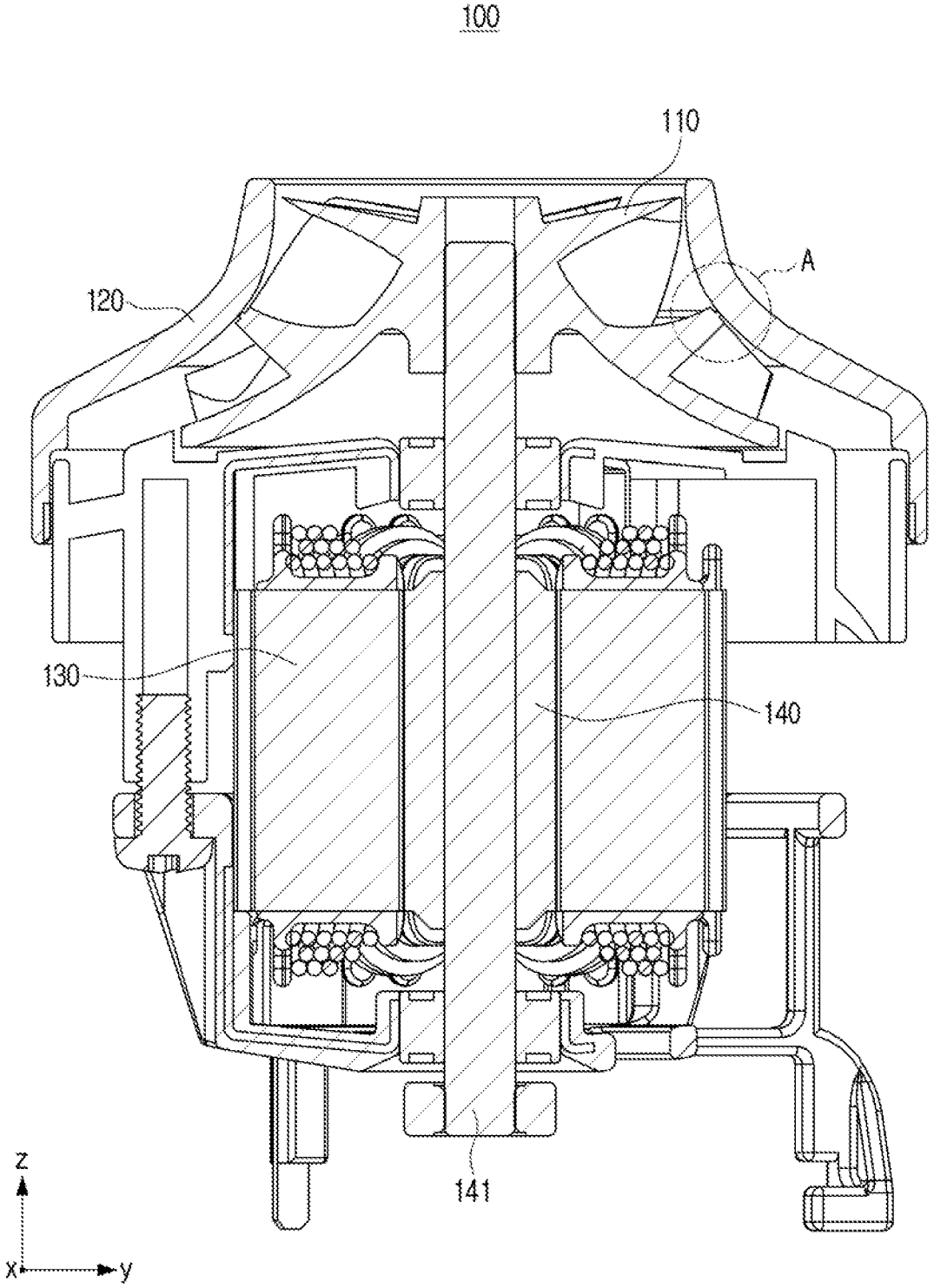
FIG. 7 is a cross-sectional view illustrating a motor assembly according to an embodiment.
Figure 8:
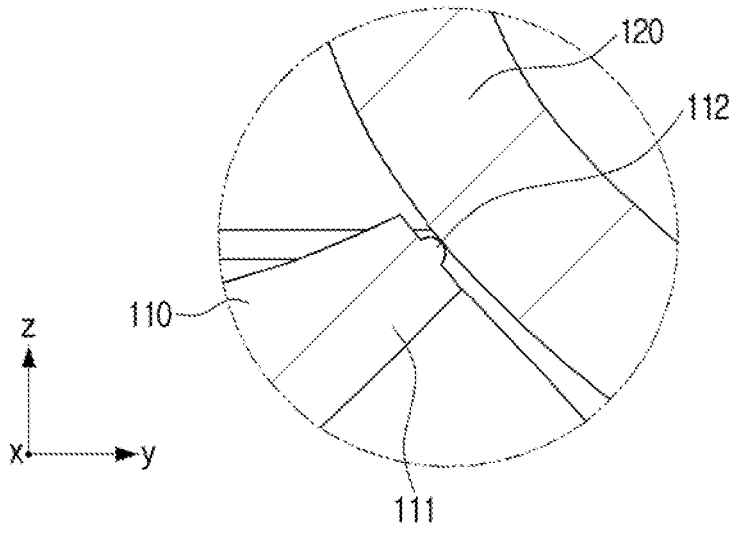
FIG. 8 is a cross-sectional view illustrating an enlarged A area of FIG. 7.

FIG. 4 is a perspective view illustrating the impeller 110 according to an embodiment, FIG. 5 is a plane view illustrating the impeller 110 of FIG. 4, FIG. 6 is a plane view illustrating an impeller according to another embodiment, FIG. 7 is a cross-sectional view illustrating the motor assembly 100 according to an embodiment, and FIG. 8 is a cross-sectional view illustrating an enlarged A area of FIG. 7.

Referring to FIG. 4, the impeller 110 may include a shaft coupling portion 113 configured to connect with the rotation shaft 141 of the rotor 140, a hub 114 configured to guide air flow, and a plurality of wings 111 configured to generate suction force, and a protrusion 112 configured to be disposed on at least one wing 111.

The protrusion 112 may be protrudingly formed from one side of the plurality of wings 111 of the impeller 110. The protrusion 112 may be disposed at a position in which the wing 111 is configured to contact with an inside surface of the impeller cover 120 on the wing 111. Accordingly, when manufacturing the motor assembly 100 according to an embodiment of the disclosure, the impeller 110 may be disposed spaced apart from the impeller cover 120 by a height the protrusion 112 is protruded from the impeller 110 just by disposing the impeller 110 and the impeller cover 120 to be in contact, without the manufacturing process of controlling to maintain a certain distance between the impeller 110 and the impeller cover 120. The manufacturing method of the motor assembly 100 will be described in detail below.

Referring to FIG. 5, the number of protrusions 112 may be three, and each of the protrusions 112 may be disposed on each of the three wings 111 which are different from one another.

Accordingly, when the impeller cover 120 is mounted on top of the impeller 110, the plurality of wings 111 may be disposed spaced apart having the same distance with the impeller cover 120, and the distance between the impeller 110 and the impeller cover 120 may be constantly formed.

Based on three protrusions 112 being disposed on wings 111 different from one another, the three protrusions 112 may all be in contact with the impeller cover 120 when the impeller cover 120 is mounted on the impeller 110. Accordingly, the distance which is constantly formed between the impeller 110 and the impeller cover 120 may be stably maintained.

In addition, three protrusions 112 may be disposed on the plurality of wings 111 and not wings 111 disposed adjacent to one another, thereby maintaining the distance between the impeller 110 and the impeller cover 120 more stably. For example, referring to FIG. 5, based on the number of wings 111 being eight, each protrusion may be disposed on the second closest wing 111 or the third closest wing 111 based on the different wing 111 on which protrusions 112 are disposed.

In the above, an example of the number of protrusions 112 being three, and the number of wings 111 being eight has been described, but the number of protrusions 112 and the number of the wings 111 are not limited thereto, and the number of protrusions 112 may be one or two, and the plurality of protrusions 112 may each be disposed on all of the plurality of wings 111 as shown in FIG. 6.

In addition, a plurality of protrusions 112 may be disposed on one wing 111.

A structure of the protrusion 112 formed on the wing 111 of the impeller 110 and a function of the protrusion 112 according to an operation of the motor assembly 100 will be described in detail below with reference to FIGS. 7 and 8.

Referring to FIGS. 7 and 8, the protrusion 112 may be disposed between the impeller cover 120 and the wing 111. For example, the protrusion 112 may be formed on a surface on which the wing 111 is configured to face the impeller cover 120. That is, the protrusion 112 may be positioned at the distance which is formed between the wing 111 and the impeller cover 120.

When the distance between the impeller 110 and the impeller cover 120 is at a minimum, the suction performance of the motor assembly 100 may be at its maximum. Accordingly, the distance between the impeller 110 and the impeller cover 120 formed by the protrusion 112 may be set to a minimum length which may maximize the suction performance of the motor assembly 100.

For example, the height of the protrusion 112 may be between 0.1 mm and 0.3 mm, and the distance between the impeller 110 and the impeller cover 120 may have a length corresponding to the height of the protrusion 112. Accordingly, one end of the protrusion 112 may be configured to contact the inside surface of the impeller cover 120.

Based on the height of the protrusion 112 being greater than 0.3 mm, the distance between the impeller 110 and the impeller cover 120 may be greater than or equal to 0.3 mm, and the suction performance of the motor assembly 100 may be weak compared to when the distance is less than 0.3 mm.

Meanwhile, based on the height of the protrusion 112 being less than 0.1 mm, an excessive contact between the impeller 110 and the impeller cover 120 may be generated thereby hindering the rotation of the impeller 110 by frictional resistance, and accordingly the suction performance of the motor assembly 100 may be deteriorated.

Accordingly, by forming the height of the protrusion 112 to between 0.1 mm and 0.3 mm, the suction performance of the motor assembly 100 may be maximized.

A method which allows for reducing frictional force according contact between the protrusion 112 and the impeller cover 120 will be described below.

The protrusion 112 may be comprised of a material with small frictional force. For example, the protrusion 112 may be comprised of any one material from among Teflon, a material comprised in part of Teflon, and a material coated with Teflon.

Accordingly, when the motor is driven, the fictional force which generates between the impeller 110 and the impeller cover 120 may be minimized and the suction performance of the motor assembly 100 may be enhanced.

The whole of the impeller cover 120 or the area in which the impeller cover 120 contacts with the protrusion 112 of the impeller 110 may be comprised of a material with small frictional force, and the frictional force generated between the impeller 110 and the impeller cover 120 may be minimized.

The protrusion 112 may be comprised of a material having a lower hardness than the impeller cover 120. In this case, the protrusion 112 may be worn because of contact with the impeller cover 120 according to the impeller 110 rotating.

Accordingly, the frictional force which generates between the protrusion 112 and the impeller cover 120 may reduce and the suction performance of the motor assembly 100 may be enhanced.

However, the relative hardness between the protrusion 112 and the impeller cover 120 is not limited thereto. Alternatively to the previous example, the whole of the impeller cover 120 or the area in which the impeller cover 120 contacts with the protrusion 112 of the impeller 110 may be comprised of a material having a lower hardness than the protrusion 112.

In this case, the area in which the impeller cover 120 contacts with the protrusion 112 may be worn because of contact with the protrusion 112, and like the previous example, the frictional force which generates between the protrusion 112 and the impeller cover 120 may reduce and the suction performance of the motor assembly 100 may be enhanced.

When the motor assembly 100 is operated, the impeller 110 which is connected to the rotation shaft 141 of the rotor 140 may rotate and generate suction force. Accordingly, the impeller 110 may introduce air through the inlet 121 of the impeller cover 120.

In addition, when the impeller 110 is rotated, the impeller 110 may be configured so that displacement occurs in the +Z-axis direction by centrifugal force. Accordingly, the plurality of wings 111 of the impeller 110 may be in contact with the impeller cover 120.

In this case, frictional force with respect to the rotation of the impeller 110 may be generated because of the frictional force from contact between the impeller 110 and the impeller cover 120, and accordingly, the suction performance of the motor assembly 100 may be deteriorated.

Based on the protrusion 112 being disposed between the wing 111 and the impeller cover 120, the contact area between the impeller 110 and the impeller cover 120 may be reduced.

Referring to FIG. 8, a distance may be present between the wing 111 of the impeller 110 and the impeller cover 120, and the protrusion 112 having a height corresponding to the corresponding distance may be disposed.

Accordingly, the area in which the impeller 110 and the impeller cover 120 are in contact may be the area in which one end of the protrusion 112 is configured to contact with the impeller cover 120. Accordingly, the frictional force which generates between the impeller 110 and the impeller cover 120 may be minimized, and thereby the suction performance of the motor assembly 100 may be enhanced.

FIGS. 9 to 12 are views illustrating a motor assembly 200 according to another embodiment.

Figure 9:
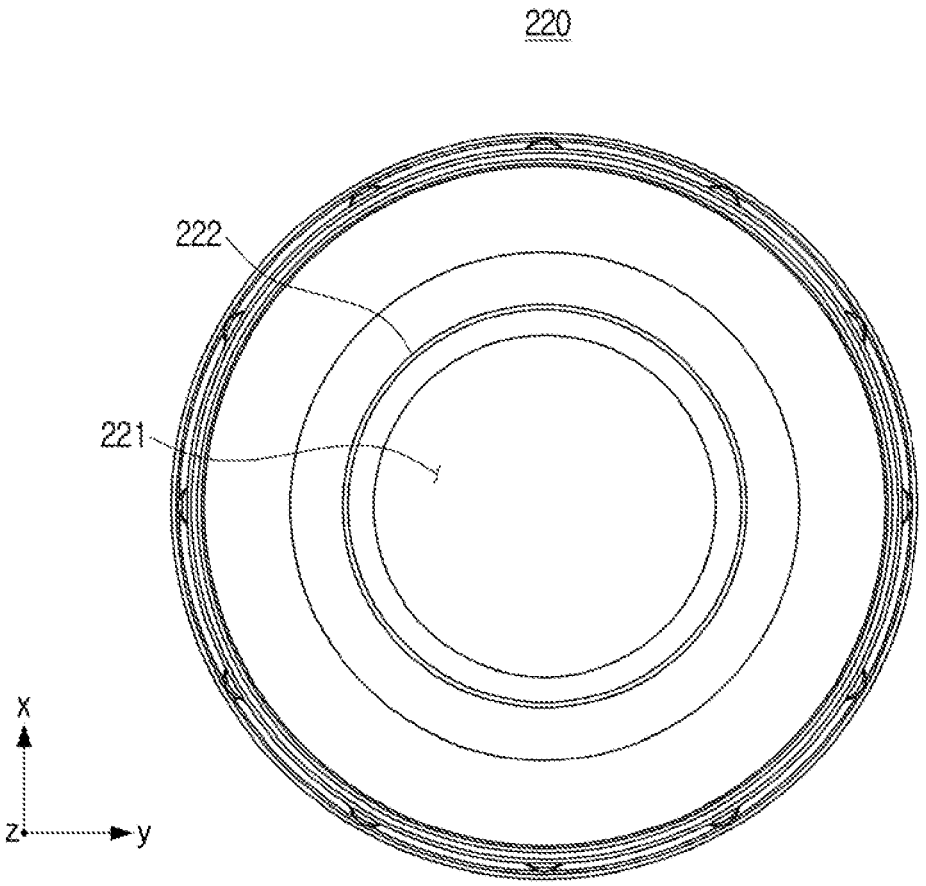
FIG. 9 is a bottom view illustrating an impeller cover according to another embodiment.
Figure 10:
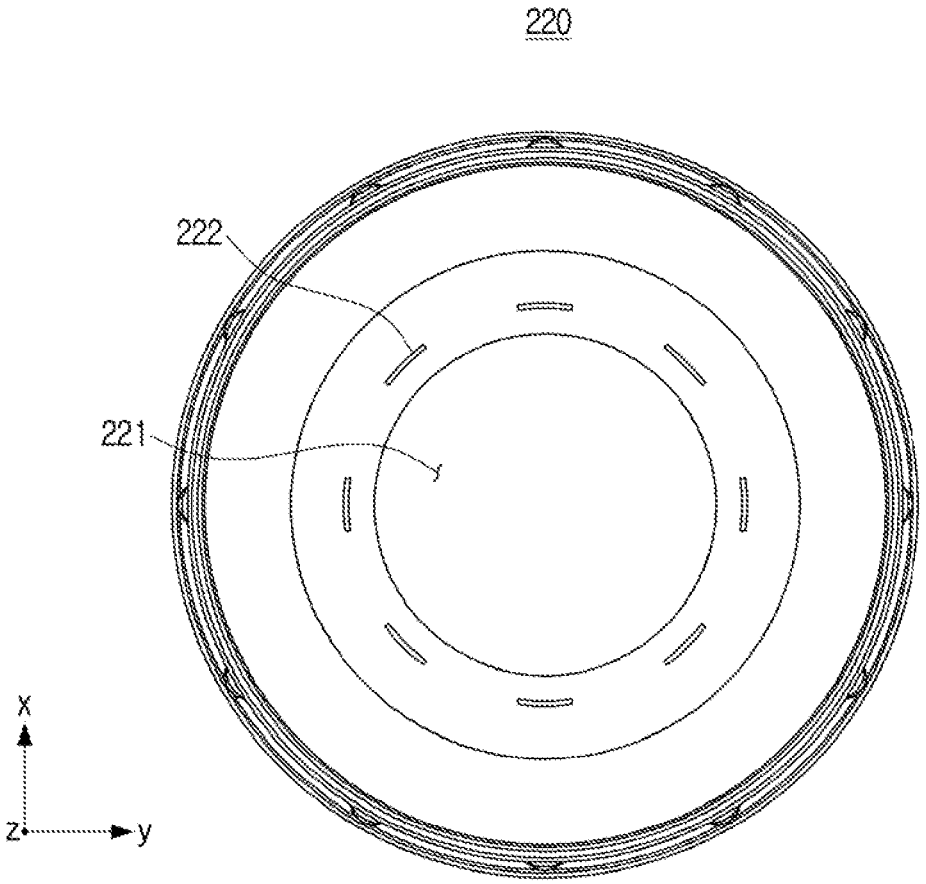
FIG. 10 is a bottom view illustrating an impeller cover according to still another embodiment.
Figure 11:
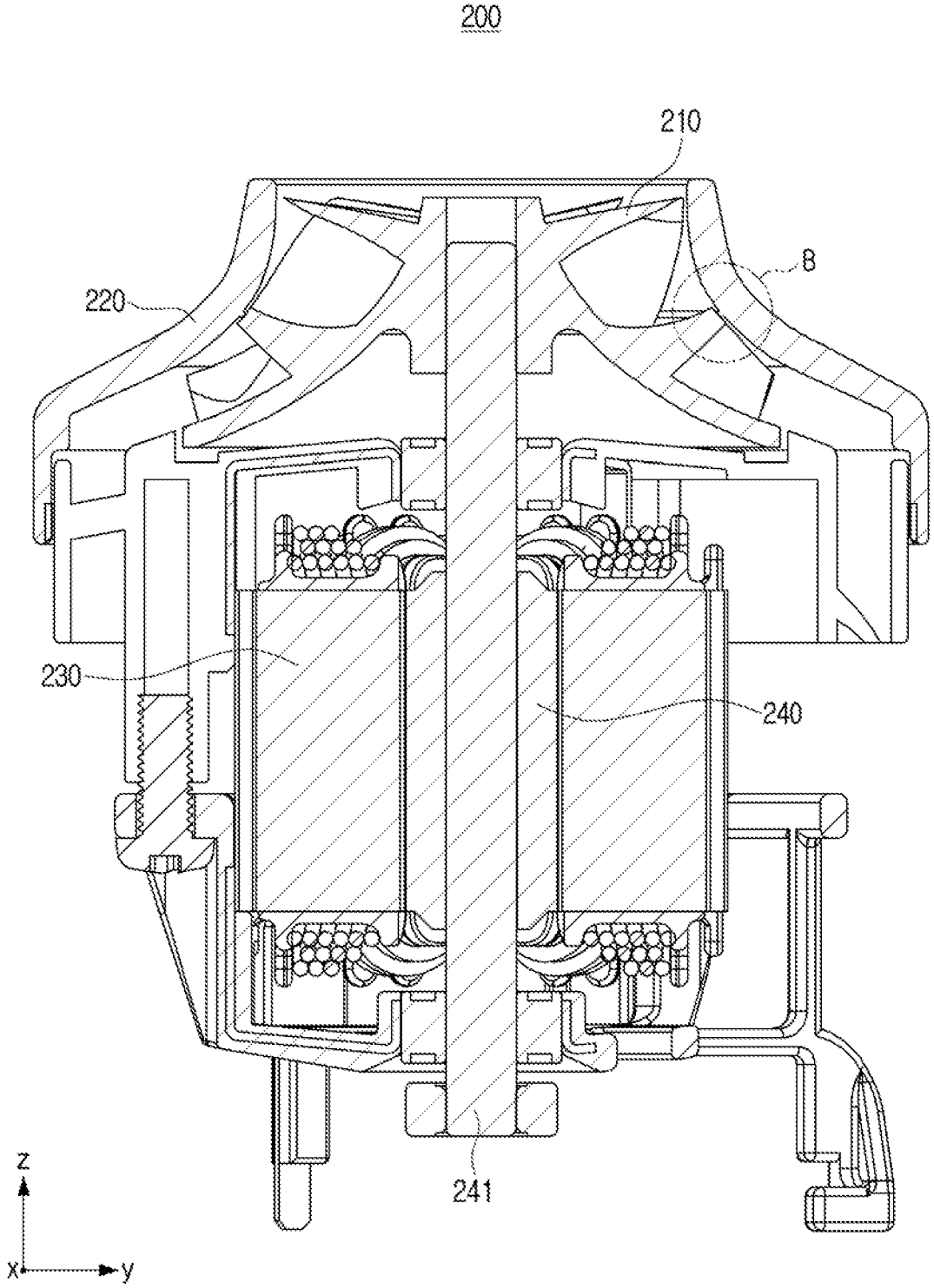
FIG. 11 is a cross-sectional view of a motor assembly according to another embodiment.
Figure 12:
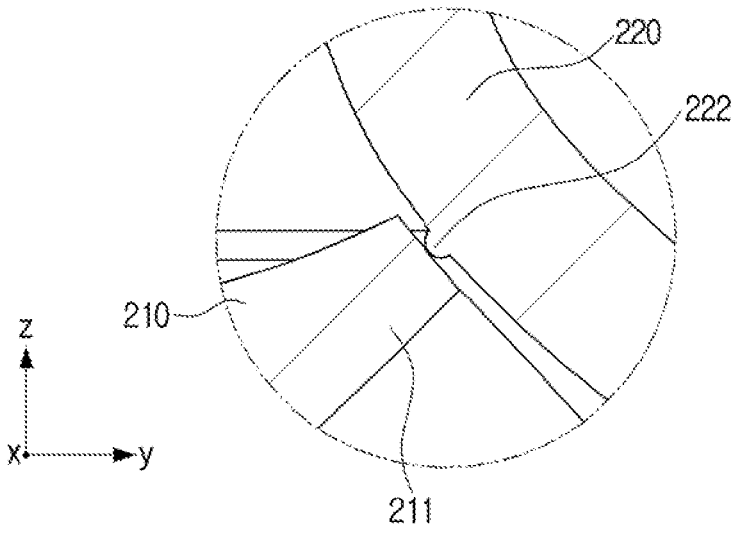
FIG. 12 is a cross-sectional view illustrating an enlarged B area of FIG. 11.

FIG. 9 is a bottom view illustrating a impeller cover 220 according to another embodiment, FIG. 10 is a bottom view illustrating the impeller cover 220 according to still another embodiment, FIG. 11 is a cross-sectional view of the motor assembly 200 according to another embodiment, and FIG. 12 is a cross-sectional view illustrating an enlarged B area of FIG. 11.

Referring to FIG. 9, the impeller cover 220 may include an inlet 221 configured so that air is introduced to an upper part, and a protrusion 222 at an inside surface.

Because the detailed description on the effect according to the function of the protrusion 222 and the height of the protrusion 222 formed on the impeller cover 220 has been described with respect to the protrusion 112 formed on the impeller 110 described above, overlapping descriptions will be omitted.

The protrusion 222 may have various forms. For example, referring to FIG. 9, the protrusion 222 may formed in a line form along the inner circumferential surface of the impeller cover 220, and may have a circular form which is formed continuously along the inner circumferential surface of the impeller cover 120.

Referring to FIG. 10, the protrusion 222 may have a dotted-line form which is formed discontinuously along the inner circumferential surface of the impeller cover 220. In this case, when manufacturing the motor assembly 200, each of the protrusions 222 may be disposed to contact the wings 211 different from one another of the impeller 210. In FIG. 10, an example of discontinuously formed protrusions 222 being eight has been described, but the number of protrusions 222 is not limited thereto, and the number may be three, one or two.

Referring to FIGS. 11 and 12, the protrusion 222 may be disposed between the impeller cover 220 and the wing 211 of the impeller 210. The protrusion 222 may be protrudingly formed from the inside surface of the impeller cover 220 toward the wing 211.

Because the detailed description on the contact between the protrusion 222 and the impeller cover 220 according to the operation of the motor assembly 100, the form of the protrusion 222, and the material of the protrusion 222 and the impeller cover 220 have been described with reference to FIGS. 4 to 8 above, overlapping descriptions thereof will be omitted.

Meanwhile, a manufacturing method of the motor assembly 100 which is enhanced in suction performance by forming a protrusion 112 on the impeller 110 will be provided.

Figure 13:
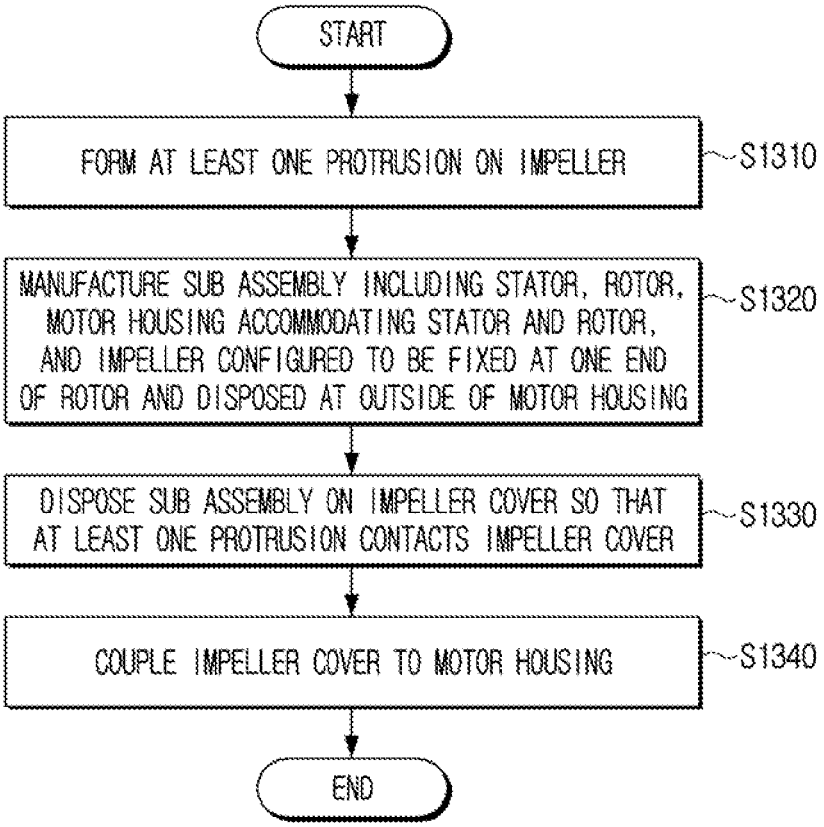
FIG. 13 is a flowchart illustrating a manufacturing method of a motor assembly according to an embodiment.
Figure 14:
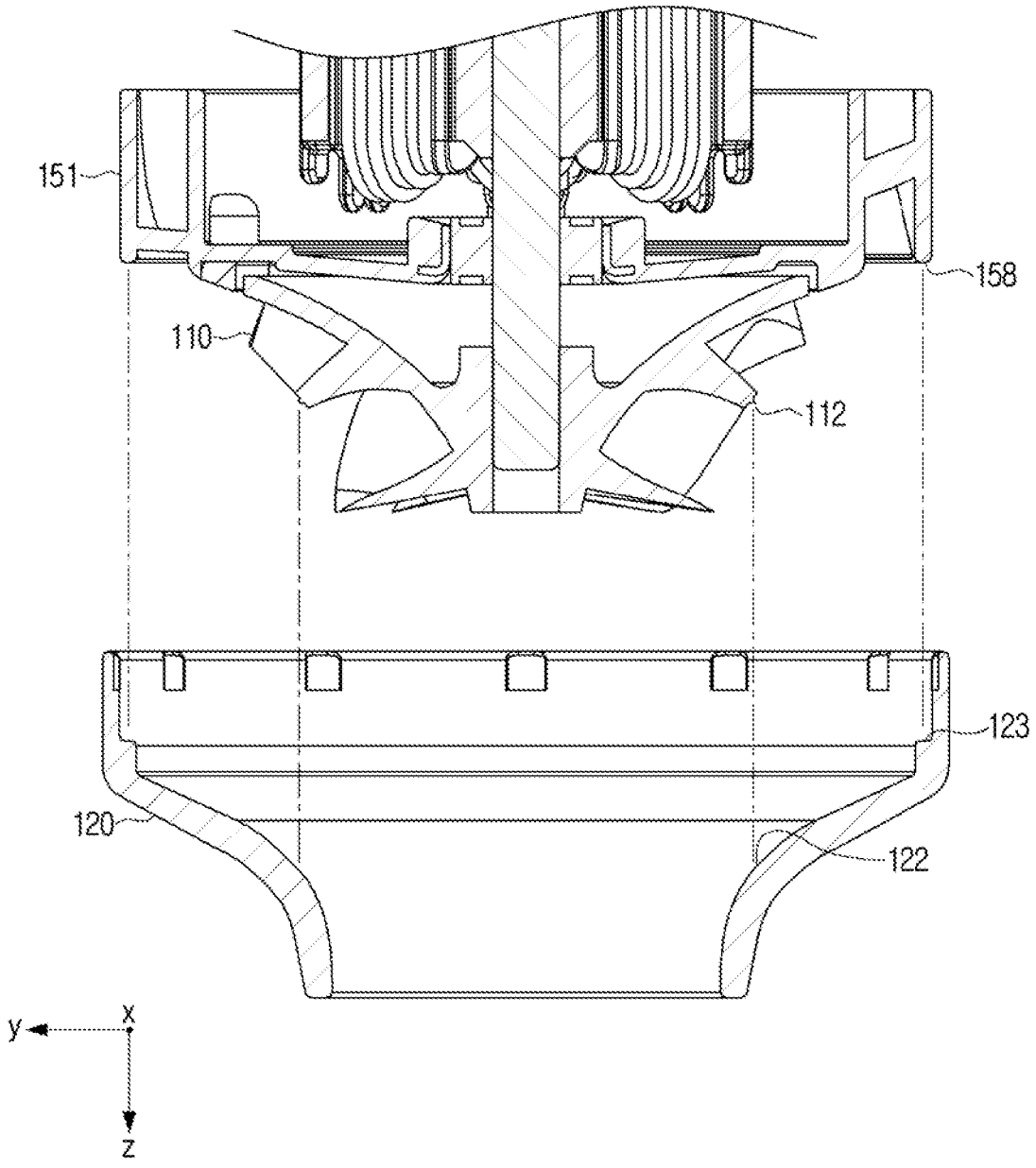
FIG. 14 is a view illustrating a manufacturing method of a motor assembly according to an embodiment representing a state prior to an impeller cover and a motor housing being coupled.
Figure 15:
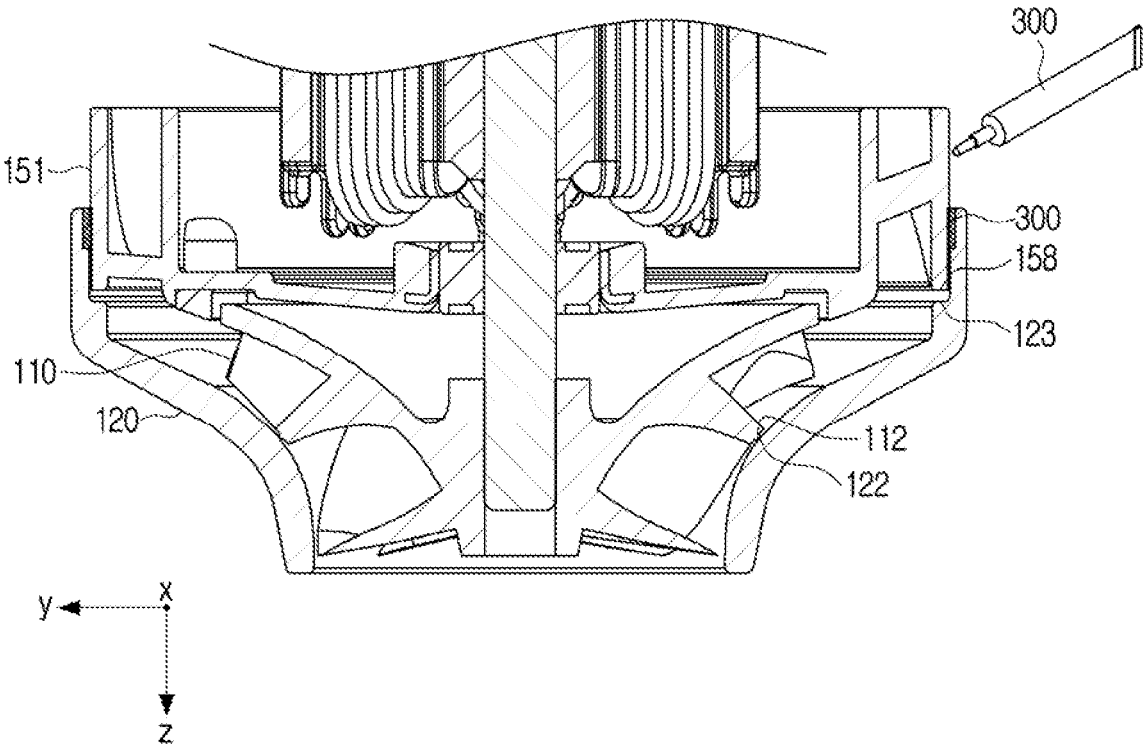
FIG. 15 is a view illustrating a manufacturing method of a motor assembly according to an embodiment representing a state after an impeller cover and a motor housing are coupled.

Referring to FIGS. 13 to 15, a manufacturing method of a motor assembly according to an embodiment will be described below.

FIG. 13 is a flowchart illustrating a manufacturing method of the motor assembly 100 according to an embodiment. FIGS. 14 and 15 are views illustrating the manufacturing method of the motor assembly 100 according to an embodiment, in which FIG. 14 represents a state prior to the impeller cover 120 and the motor housing 151 being coupled, and FIG. 15 represents a state after the impeller cover 120 and the motor housing 151 are coupled.

Referring to FIG. 13, the manufacturing method of the motor assembly 100 according to an embodiment may include forming at least one protrusion 112 on the impeller 110 (S1310), manufacturing a sub assembly including the impeller 110 (S1320), disposing the sub assembly on the impeller cover 120 so that at least one protrusion 112 contacts the impeller cover 120 (S1330), and coupling the impeller cover 120 to the motor housing 151 (S1340).

The sub assembly may be a configuration generated in a step prior to completion of the motor assembly 100, and may include some configurations of the motor assembly 100. For example, the sub assembly may include the stator 130, the rotor 140, motor housings 151 and 154 which accommodate the stator 130 and the rotor 140, and the impeller 110 which is fixed to one end of the rotor 140 and disposed at an outside of the motor housings 151 and 154.

By disposing the sub assembly on the impeller cover 120 so that the protrusion 112 is configured to contact the impeller cover 120 according to the manufacturing method described above, the impeller 110 may be disposed spaced apart from the impeller cover 120 by the height the protrusion 112 is protruded from the impeller 110.

Accordingly, the motor assembly 100 in which the distance between the impeller 110 and the impeller cover 120 is maintained at a minimum may be manufactured just by setting the height of the protrusion 112 to a minimum distance and disposing so that the impeller 110 and the impeller cover 120 are in contact without the manufacturing process of controlling to maintain a certain distance between the impeller 110 and the impeller cover 120.

In addition, regardless of an assembly tolerance of several components of the motor assembly 100, the distance between the impeller 110 and the impeller cover 120 may be maintained and the motor assembly 100 may be manufactured with enhanced reliability.

The impeller cover 120 and the motor housing 151 may be coupled in various methods. For example, the impeller cover 120 and the motor housing 151 may be bonding coupled through a bonding agent.

Referring to FIGS. 14 and 15, in order to couple the impeller cover 120 and the motor housing 151, the sub assembly including the impeller 110 and the motor housing 151 may be disposed on the impeller cover 120.

Referring to FIG. 15, the sub assembly may receive force in the +Z-axis direction by self-weight, and may be configured to stop at the position in which the protrusion 112 of the impeller 110 is in contact with an inside surface 122 of the impeller cover 120.

After the sub assembly is seated in the impeller cover 120, a bonding agent 300 may be applied along the space between the impeller cover 120 and the motor housing 151. In this case, the impeller cover 120 and the motor housing 151 may be coupled through the bonding agent 300 at the position in which the protrusion 112 is disposed to contact the impeller cover 120. Accordingly, the motor assembly 100 in which the minimum distance between the impeller 110 and the impeller cover 120 is maintained may be manufactured.

According to a manufacturing method of a motor assembly according to another embodiment, the bonding agent 300 may be applied to the impeller cover 120 prior to disposing the sub assembly on the impeller cover 120.

Figure 16:
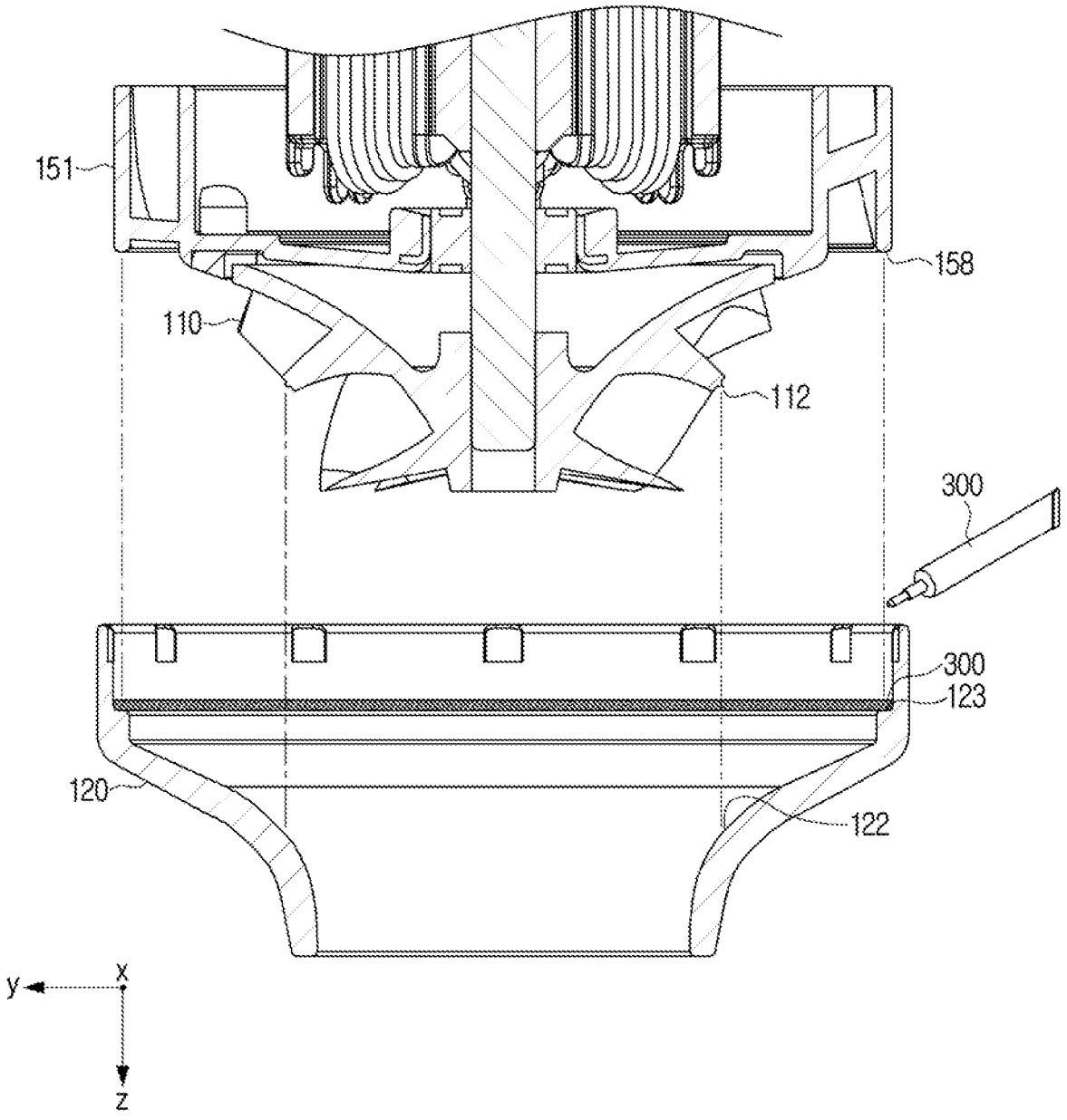
FIG. 16 is a view illustrating a manufacturing method of a motor assembly according to another embodiment representing a state prior to an impeller cover and a motor housing being coupled.
Figure 17:
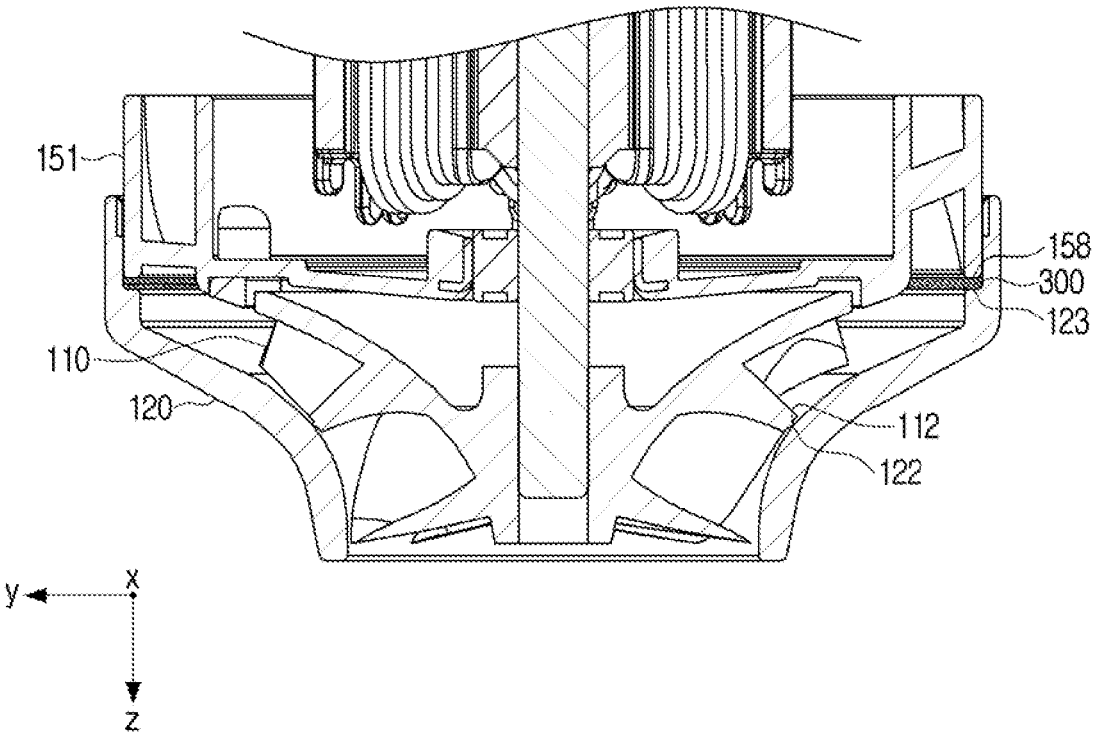
FIG. 17 is a view illustrating a manufacturing method of a motor assembly according to another embodiment representing a state after an impeller cover and a motor housing are coupled.

The manufacturing method of the motor assembly according to another embodiment will be described below with reference to FIGS. 16 to 17. FIG. 16 represents a state prior to the impeller cover 120 and the motor housing 151 being coupled, and FIG. 17 represents a state after the impeller cover 120 and the motor housing 151 are coupled.

Referring to FIG. 16, prior to the sub assembly including the impeller 110 and the motor housing 151 being disposed on the impeller cover 120, the bonding agent 300 may be applied along a first coupling surface 123 inside the impeller cover 120. However, the area to which the bonding agent 300 is applied is not limited thereto, and may be applied to other areas in which the impeller cover 120 and the motor housing 151 are in contact when the motor housing 151 is disposed on the impeller cover 120.

After the bonding agent 300 is applied, the sub assembly may be disposed on the impeller cover 120. Referring to FIG. 17, the sub assembly may receive force in the +Z-axis direction by self-weight, and may be configured to stop at the position in which the protrusion 112 of the impeller 110 is in contact with an inside surface 122 of the impeller cover 120. In this case, the first coupling surface 123 of the impeller cover 120 and second coupling surface 158 of the motor housing 151 may be coupled through the bonding agent 300 at a position in which the protrusion 112 is disposed to contact the impeller cover 120. Accordingly, the motor assembly 100 in which the minimum distance between the impeller 110 and the impeller cover 120 is maintained may be manufactured.

However, the coupling method of the impeller cover 120 and the motor housing 151 is not limited thereto, and coupling may be carried out through a method of a bonding agent being injected to a contact area after disposing the motor housing 151 on the impeller cover 120 or a method of applying a bonding agent to an outside of the contact area.

The manufacturing method of the motor assembly 100 may further include rotating the impeller 110 for a pre-set time after coupling the impeller cover 120 to the motor housing 151.

Based on rotating the impeller 110 for a pre-set time, the area in which the protrusion 112 or the impeller cover 120 contacts with the protrusion 112 may be worn. Accordingly, the frictional force which generates between the protrusion 112 and the impeller cover 120 may reduce and the suction performance of the motor assembly 100 may be enhanced.

Meanwhile, in rotating the impeller 110, the impeller 110 may be rotated at a speed higher than a regular rotation speed of the motor assembly 100. Accordingly, the area in which the protrusion 112 or the impeller cover 120 contacts with the protrusion 112 may be more effectively worn.

While the disclosure has been illustrated and described with reference to various example embodiments thereof, it will be understood that the various example embodiments are intended to be illustrative, not limiting. It will be understood by those skilled in the art that various changes in form and details may be made therein without departing from the true spirit and full scope of the disclosure, including the appended claims and their equivalents.

What is claimed is:

1. A motor assembly, comprising:

a motor having a stator and a rotor rotatable about an axis;

an impeller having a plurality of wings, the impeller being configured to connect to the rotor of the motor while the impeller is arranged along a direction of the axis about which the rotor is rotatable; and an impeller cover, configured to cover a side surface of the impeller, having an inlet, the impeller cover facing the impeller along the direction of the axis about which the rotor is rotatable while the impeller cover covers the side surface of the impeller, wherein the impeller cover includes:

at least one protrusion to protrude from an inner circumferential surface of the impeller cover so that while the impeller cover covers the side surface of the impeller, the at least one protrusion of the impeller cover is between the impeller and the impeller cover and spaces the inner circumferential surface of the impeller cover apart from the impeller by a distance according to a height of the at least one protrusion along the direction of the axis about which the rotor is rotatable, wherein when the impeller rotates, the at least one protrusion of the impeller cover is worn by the plurality of wings of the impeller, and wherein the at least one protrusion is among multiple protrusions and each of the multiple protrusions are configured to be formed discontinuously along the inner circumferential surface of the impeller cover in a dotted-line form so that each of the multiple protrusions is in contact with a separate wing of the plurality of wings.

2. The motor assembly of claim 1, wherein the at least one protrusion is at a position on the inner circumferential surface of the impeller cover that corresponds with a position of at least one wing among the plurality of wings of the impeller to thereby be in contact with the at least one wing among the plurality of wings.

3. The motor assembly of claim 2, wherein the at least one protrusion has a height between 0.1 mm and 0.3 mm.

4. The motor assembly of claim 1, wherein the at least one protrusion is comprised of a material having a lower hardness than the impeller.

5. The motor assembly of claim 1, wherein the at least one protrusion includes two or more protrusions.

6. A cleaner comprising:

a cleaner body; and a motor assembly disposed in the cleaner body, wherein the motor assembly comprises:

a motor having a stator and a rotor rotatable about an axis;

an impeller having a plurality of wings, the impeller being configured to connect to the rotor of the motor while the impeller is arranged along a direction of the axis about which the rotor is rotatable; and an impeller cover, configured to cover and contact a side surface of the impeller, having an inlet, the impeller cover facing the impeller along the direction of the axis about which the rotor is rotatable while the impeller cover covers the side surface of the impeller wherein the impeller cover includes:

at least one protrusion to protrude from an inner circumferential surface of the impeller cover so that the impeller cover covers and contacts the side surface of the impeller through the at least one protrusion that is between the side surface of the impeller and the impeller cover, the at least one protrusion spacing the inner circumferential surface of the impeller cover apart from the impeller by a distance according to a height of the at least one protrusion along the direction of the axis about which the rotor is rotatable, wherein when the impeller rotates, the at least one protrusion of the impeller cover is worn by the plurality of wings of the impeller, and wherein the at least one protrusion is among multiple protrusions and each of the multiple protrusions are configured to be formed discontinuously along the inner circumferential surface of the impeller cover in a dotted-line form so that each of the multiple protrusions is in contact with a separate wing of the plurality of wings.

* * * * *